US007815547B2

(12) United States Patent
Wu

(10) Patent No.: US 7,815,547 B2
(45) Date of Patent: Oct. 19, 2010

(54) EXERCISE SYSTEM CAPABLE OF PROVIDING HEART RATE DETECTION WARNING AND CONTROL METHOD THEREOF

(76) Inventor: Mu-Chuan Wu, No. 462-7, Chung Shan Rd., Hsi-Kang Chun, Hsi-Kang Hsaing, Tainan Hsien (TW)

( * ) Notice: Subject to any disclaimer, the term of this patent is extended or adjusted under 35 U.S.C. 154(b) by 140 days.

(21) Appl. No.: 12/231,761

(22) Filed: Sep. 5, 2008

(65) Prior Publication Data

US 2009/0312150 A1 Dec. 17, 2009

(30) Foreign Application Priority Data

Jun. 11, 2008 (TW) ..... 97121638 A

(51) Int. Cl.
*A63B 71/00* (2006.01)

(52) U.S. Cl. ..... 482/8; 482/1; 482/9; 482/901; 600/300

(58) Field of Classification Search ..... 482/1–9, 482/51, 900–902; 434/247; 600/300; 601/23
See application file for complete search history.

(56) References Cited

U.S. PATENT DOCUMENTS

2004/0229729 A1* 11/2004 Albert et al. ..... 482/8
2007/0219059 A1* 9/2007 Schwartz et al. ..... 482/8
2008/0076637 A1* 3/2008 Gilley et al. ..... 482/9

* cited by examiner

*Primary Examiner*—Glenn Richman
(74) *Attorney, Agent, or Firm*—William E. Pelton, Esq.; Cooper & Dunham LLP

(57) ABSTRACT

An exercise system has an operating unit, an input unit, a detector, a control unit and a display unit. The operating unit is an operation device that receives forces exerted by a user. The input unit is for setting a personal physical parameter set of the user. The detector senses a heart rate of the user. The control unit receives the personal physical parameter set from the input unit, receives the heart rate from the detector, defines a boundary heart rate according to the personal physical parameter set and generates a display command by comparing the heart rate with the boundary heart rate. The display unit receives the display command to accordingly generate a safety indication signal. The user can prevent injuries or over-training fatigue by perceiving the safety indication signal and then adjust the exercise intensity.

9 Claims, 3 Drawing Sheets

EXERCISE SYSTEM CAPABLE OF PROVIDING HEART RATE DETECTION WARNING AND CONTROL METHOD THEREOF

BACKGROUND OF THE INVENTION

1. Field of the Invention

The present invention relates to an exercise system and control method thereof, especially relates to an exercise system that can measure the heart rate of an exercising person and warn the exercising person to adjust exercise intensity for fitting his physical condition.

2. Description of the Related Art

A conventional exercise machine can provide different exercising or training modes that are preset by the producer. The conventional exercise machine includes a motive power generating apparatus and a control circuit. The control circuit controls the motive power generating apparatus to be operated in different mechanical motion modes. For example, a treadmill has a belt driven by a motor assembly. The motor assembly is controlled by a control circuit to increase or decrease it's revolutions for changing the moving speed of the belt. Thus when running on the moving belt, the user must adjust his/her running speeds to accommodate the moving belt. The user then can experience different extents of sports effect.

Foregoing training modes may be different according to different kinds of exercise machine. Exercise machines that does not generate motive power, like an exercise bike, may have its training modes displayed in an LCD and implemented in different exercise postures with different exercise time periods.

Even thought the exercise machine is operated in the same training mode, users may have different sports effects due to their differences of personal physical parameters, such as age, height, weight, etc.

The conventional exercise machine may further have a manual mode that allows the user to create a customized training program, which is more flexible than the preset modes. With an expert's assistance and teaching, the user may create an appropriate training program according to his/her own physical parameters. However, the user's physical parameters may not objectively represent his/her physical condition. Two persons of the same physical parameters may have different physical conditions if one has regular exercise and the other doesn't or one is energetic and the other is exhausted. Therefore the user may feel uncomfortable due to the tired body or lack of regular exercise even though the exercise machine is running under an appropriate training program designed for the user's physical parameters.

SUMMARY OF THE INVENTION

One objective of the present invention is to provide an exercise system and control method thereof that can measure heart rate of an exercising person and generate an safety indicating signal to warn the exercising person to adjust exercise intensity for fitting his physical condition.

The exercise system in accordance with the present invention comprises an operating unit, an input unit, a detector and a control unit. The input unit is for a user to set a personal physical parameter set. The detector senses a heart rate of the user. The control unit connects to the operating unit, the input unit and the detector, receives the personal physical parameter set and the heart rate from the detector, defines a boundary heart rate according to the personal physical parameter set and compares the heart rate with the boundary heart rate to generate a display command. The display unit connects to the control unit and receives the display command to accordingly generate a safety indication signal. The power supply unit connects to the control unit and provides power to the control unit.

A control method of an exercise system in accordance with the present invention comprises steps of:

receiving a personal physical parameter set of a user and defining a boundary heart rate based on the personal physical parameter set;

receiving an operating command corresponding to a training program and displaying corresponding posture display images and parameters based on the operating command;

continually sensing the heart rate of the user and generating a display command by comparing the heart rate with the boundary heart rate;

displaying a safety indication signal according to the display command;

determining whether a modify command is received, if yes, then modifying the corresponding training programs of the original operating command to generating a new operating command and returning to the step of receiving an operating command, if not, proceeding to next step; and determining whether a stop command is received, if yes, then stopping sensing the heart rate of the user, if not, returning to the step of continually sensing the heart rate of the user.

With foregoing steps, the user can prevent injuries or overtraining fatigue by perceiving the safety indication signal and then adjust the exercise intensity. Therefore a user with bad physical condition will have a safe exercise effect.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
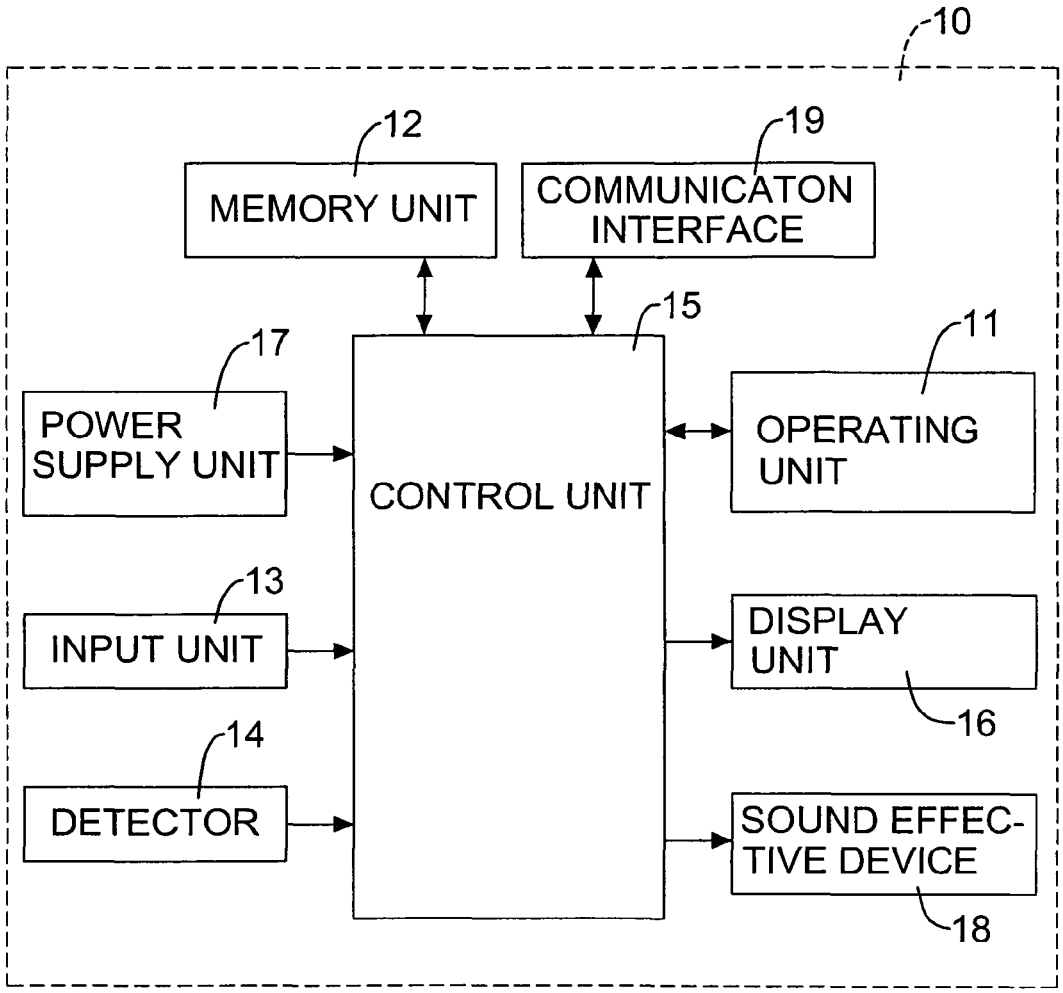
FIG. 1 is a block diagram of an exercise system in accordance with the present invention.

With reference to FIG. 1, an exercise system (10) in accordance with the present invention comprises an operating unit (11), a memory unit (12), an input unit (13), a detector (14), a control unit (15), a display unit (16), a power supply unit (17), an optional sound effect device (18) and an optional communication interface (19).

The operating unit (11) is an operation device that receives forces exerted by the user and may be a pedal device of an exercise bike. The pedal device is adapted to connect and drive a flywheel of an exercise bike and output multiple riding data, such as RPM (revolutions per minute) of the flywheel, resistance of the flywheel and the riding distance of the flywheel and the like.

The memory unit (12) stores with multiple preset training programs and multiple posture display images. Each preset training program includes multiple preset exercise parameter sets. Each preset exercise parameter set corresponds to one of the posture display images. The posture display images may be dynamic images or static images or symbols for representing the preset exercise parameter sets visually. Each preset exercise parameter set may comprise a time parameter and a posture parameter. The time parameter defines an operating time of the operating unit (11). The posture parameter selects one of the posture display images.

The input unit (13) is for a user to set a personal physical parameter set and a customized exercise parameter set and to input a mode selection command and a program selection command. The personal physical parameter set may include a weight parameter, a height parameter, an age parameter and a gender parameter. The customized exercise parameter set is manually set by users as desired and may include an intensity parameter, a time parameter and a posture parameter. The intensity parameter and the time parameter respectively represent an operating intensity and an operating time of the operating unit (11). The posture parameter designates one of the posture display images stored in the memory unit (12). According to the customized exercise parameter set, the operating unit (11) of the exercise system (10) will be operated for the operating time with the operating intensity, and the exercise system (10) will show the designated posture display image. When the exercise system (10) is implemented in an exercise bicycle, the operating intensity represents the magnitude of resistance of the flywheel of the exercise bicycle.

The detector (14) senses heart rate of the user.

The control unit (15) connects to the operating unit (11), the memory unit (12), the input unit (13) and the detector (14), receives the personal physical parameter set, the customized exercise parameter set, the mode selection command or the program selection command from the input unit (13) and receives the heart rate from the detector (14). According to the personal physical parameter set, the control unit (15) may define a boundary heart rate with a personal heart rate formula, compare the heart rate with the boundary heart rate and generate a display command. Based on the customized exercise parameter set, the control unit (15) may generate a manual operating command. Based on the program selection command, the control unit (15) may designate a training program and generate an automatic operating command corresponding to the designated training program. The personal heart rate formula may be:

$$\text{Boundary heart rate} = 220 - (\text{age parameter} \times \text{intensity parameter})\ \%$$

boundary heart rate The control unit (15) may further calculate the calories that an exercising user has consumed by a calculation formula:

$$\text{Calories (kcal)} = \frac{(2 \times \pi \times Nm \times RPM/60) \times 0.01433}{0.23};\ \text{or}$$

$$\text{Calories (kcal)} = \left\{\frac{(\text{Intensity} \times METS \times \text{Weight} \times \text{Time})}{1000}\right\} \times 4.924;$$

wherein Nm=Newton meter;

RPM=revolutions per minute of the flywheel;

METS=Metalbolic Equivalent, a MET is defined as oxygen uptake in ml/kg/min with one MET equal to the oxygen cost of sitting quietly, equivalent to 3.5 ml/kg/min.

The display unit (16) connects to the control unit (15), receives the display command to accordingly generate a safety indication signal and may display the posture display image of the memory unit (12), the riding data of the operating unit (11), personal physical parameter set input by the input unit (13), heart rate from the detector (14), corresponding parameters of automatic or manual operating command from control unit and the calculated calories for reference.

The power supply unit (17) connects to the control unit (15) and provides power to the control unit (15) and other elements connecting to the control unit (15).

The sound effect device (18) connects to the control unit (15) and generates a sound when the training program is started or finished.

The communication interface (19) connects to the control unit (15) and may be implemented as a wired RS-232 to USB connecting interface, an infrared module, a RF module or a bluetooth data transfer module. An external electronic device may link to the exercise system (10) via the communication interface (19).

Figure 2:
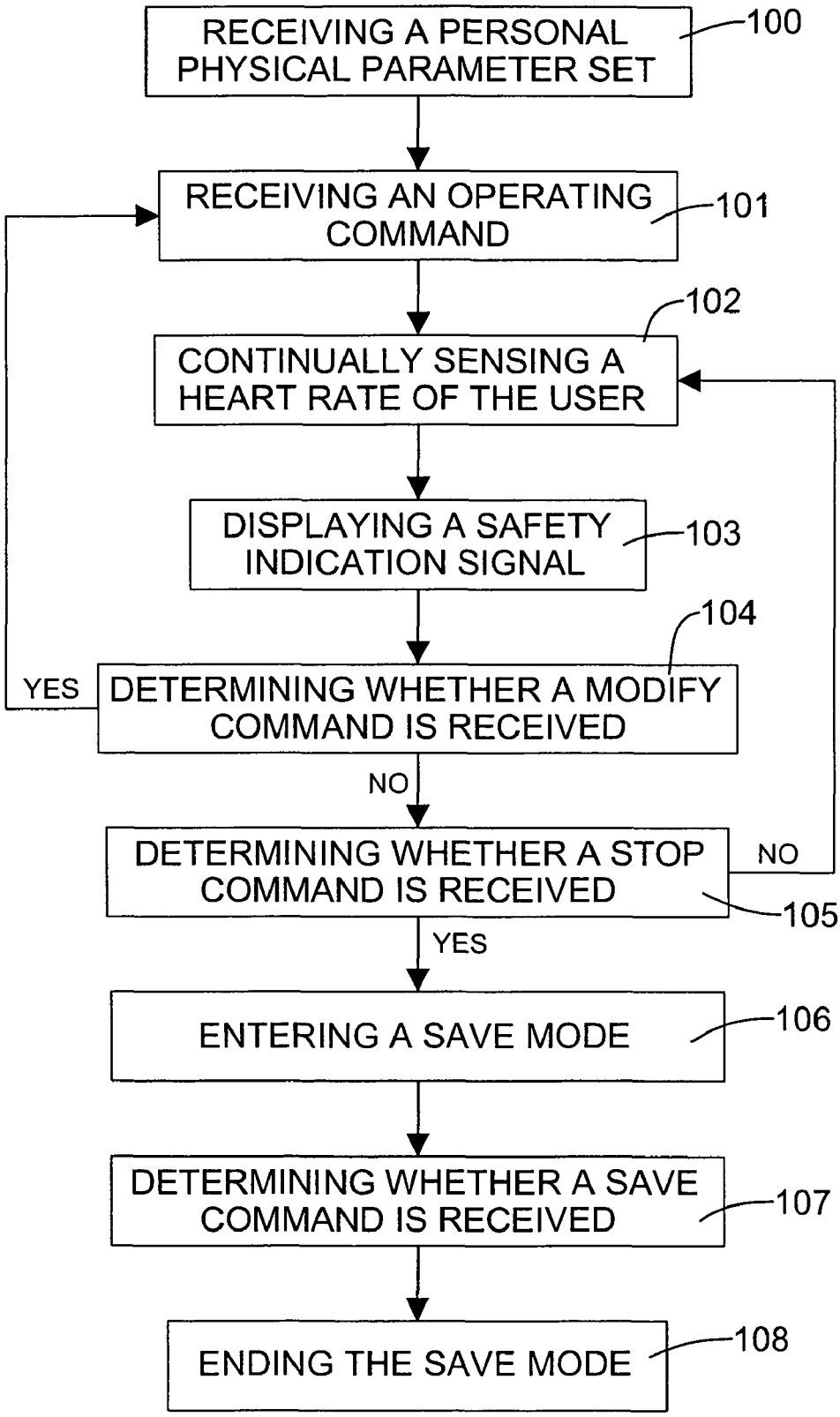
FIG. 2 is a flowchart of the control method of the exercise system in accordance with the present invention.

With reference to FIG. 2, the control method of the exercise system (10) comprises following steps of receiving a personal physical parameter set (100), receiving an operating command (101), continually sensing a heart rate of the user (102), displaying a safety indication signal (103), determining whether a modify command is received (104) and determining whether a stop command is received (105).

In the step of receiving a personal physical parameter set (100), a personal physical parameter set of a user is set to the control unit (15) via the input unit (13) and a boundary heart rate is defined by the control unit based on the personal physical parameter set. The personal physical parameter set may include a weight parameter, a height parameter, an age parameter and a gender parameter.

In the step of receiving an operating command (101), the control unit (15) receives an operating command and activates the display unit (16) according to the operating command to display the posture display image of a designated training program and corresponding parameters, like intensity, time and posture parameter. The operating command corresponds to a certain training program that is preset or is customized by the user.

In the step of continually sensing a heart rate of the user (102), the detector (14) continually senses a heart rate of the user, and the control unit (15) receives the heart rate and generates a display command by comparing the heart rate with the boundary heart rate.

In the step of displaying a safety indication signal (103), the control unit (15) thus outputs the display command to the display unit (16), and the display unit (16) displays a safety indication signal.

In the step of determining whether a modify command is received (104), the control unit (15) determines whether a modify command is received from the input unit (13). If a modify command is received, the control unit (15) modifies the corresponding training programs of the operating command to generate a new operating command and returns to step (101), otherwise the control unit (15) proceeds to the next step (105).

In the step of determining whether a stop command is received (105), if a stop command is received, the control unit (15) then stops sensing a heart rate of the user, if not, returns to step (102).

After the step of determining whether a stop command is received (105), the control method may further comprise following steps of entering a save mode (106), determining whether a save command is received (107) and ending the save mode (108).

In the step of entering a save mode (106), the display unit (16) displays a save request image to ask whether to save the operating command.

In the step of determining whether a save command is received (107), if a save command is received from the input unit (13), the control unit (15) saves the personal physical parameter set and the training program in the memory unit (12) or saves the personal physical parameter set and the training program in an external electronic device, such as an USB flash drive, via the communication interface (19).

Figure 3:
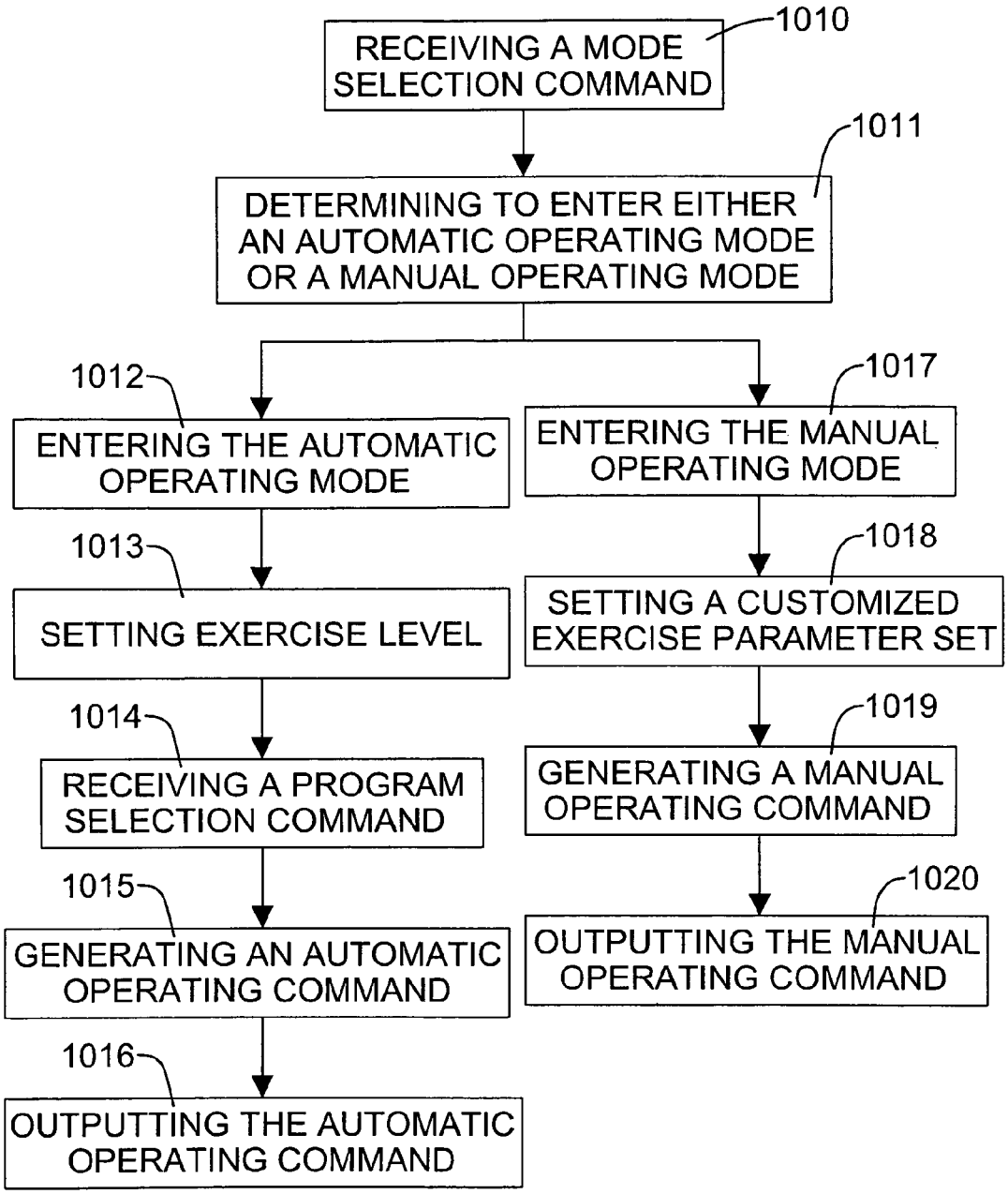
FIG. 3 is a flowchart of receiving an operating command of the control method of the exercise machine in accordance with the present invention.

With further reference to FIG. 3, the step of receiving an operating selection command (101) further comprises following steps of receiving a mode selection command (1010), determining to enter either an automatic operating mode or a manual operating mode (1011), entering the automatic operating mode (1012), setting exercise level (1013), receiving a program selection command (1014), generating an automatic operating command (1015) and outputting the automatic operating command (1016).

In the step of receiving a mode selection command (1010), a mode selection command is input to the control unit (15) via the input unit (13).

In the step of determining to enter either an automatic operating mode or a manual operating mode (1011), the control unit (15) determines whether the exercise system (10) should be operated in the automatic operating mode or the manual operating mode according to the mode selection command.

In the step of setting exercise level (1013), an intensity parameter is input to the control unit (15) via the input unit (13).

In the step of receiving a program selection command (1014), a program selection command is input to the control unit (15) via the input unit (13), the control unit (15) thus retrieves a training program corresponding to the received program selection command.

In the step of generating an automatic operating command (1015), the control unit (15) generates the automatic operating command according to the intensity parameter and the training program.

In the step of outputting the automatic operating command (1016), the control unit (15) outputs the automatic operating command to the display unit (16) to have the display unit (16) display intensity parameter and corresponding parameters and posture display images of the designated training program.

Furthermore, in the step of determining to enter either the automatic operating mode or the manual operating mode (1011), if the control unit (15) determines the exercise system (10) to be operated in the manual operating mode, following steps will be executed: entering the manual operating mode (1017), setting a customized exercise parameter set (1018), generating a manual operating command (1019) and outputting the manual operating command (1020).

In the step of setting a customized exercise parameter set (1018), a customized exercise parameter set is set to the control unit (15) via the input unit (13). The customized exercise parameter set may include intensity parameter, time parameter and posture parameter for deciding the operating intensity and operating time of the operating unit (11) and the designated posture display image.

In the step of generating a manual operating command (1019), the control unit (15) generates a manual operating command according to the customized exercise parameter set.

In the step of outputting the manual operating command (110), the control unit (15) outputs the manual operating command to the display unit (16) to have the display unit (16) display intensity parameter and corresponding parameters and posture display images of the customized exercise parameter set.

When using this exercise system (10), a user first sets his/her own personal physical parameter set (such as height, weight, age and gender), then selects the automatic operating mode or the manual operating mode. If selecting the automatic operating mode, the user further sets the exercise level (intensity parameter) and selects a desired training program (including posture display images and time parameter), then the display unit (16) starts to display intensity level, posture display images and exercise time. If selecting manual operating mode, the user further sets intensity parameter, time parameter and posture parameter of a customized exercise parameter set as a training program and the display unit (16) starts to display intensity level, posture display images and exercise time. The user hence begins to exercise with the exercise system (10) by operating the operating unit (11). The detector (14) continually senses the heart rate of the user, and the display unit (17) thus displays a safety indication signal. When the heart rate is in a safety heart rate range wherein the heart rate of the user is lower than 90% of the boundary heart rate, the safety indication signal may be a green light, the user can adjust the intensity parameter to increase or decrease the operating intensity. On the contrary, when the heart rate is out of the range wherein the heart rate of the user is higher than 90% of the boundary heart rate, the safety indication signal may turn to a red light as an alarm, the user thus knows that the intensity is too violent for bearing, then further adjusts the intensity parameter to lower the operating intensity. Besides displaying a green/red light, the display unit (16) may display a current heart rate and the boundary heart rate for reference.

After exercising, the user may save the adjusted training program and his/her personal physical parameter set as a personal training program, and further save the personal training program in an external electronic device, like External USB Hard Disk. The user may take the External USB Hard Disk to any exercise machine having the exercise system (10) to exercise with his personal training program.

The boundary heart rate may be directly input by the user after estimating his/her personal physical condition.

The advantage of the exercise system and the control method thereof is that the user can prevent injuries or overtraining fatigue by perceiving the safety indication signal and then adjust the exercise intensity. Therefore a user with bad physical condition will have a safe exercise effect. Furthermore, the user can save the adjusted training program and his/her personal physical parameter set as a personal training program for next time use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A control method of an exercise system comprising the steps of:

receiving a personal physical parameter set of a user and defining a boundary heart rate based on the personal physical parameter set;

receiving an operating command corresponding to a training program and displaying corresponding posture display images and parameters based on the operating command;

continually sensing the heart rate of the user and generating a display command by comparing the heart rate with the boundary heart rate;

displaying a safety indication signal according to the display command;

determining whether a modify command is received, if yes, then modifying the corresponding training programs of the original operating command to generating a new operating command and returning to the step of receiving an operating command, if not, proceeding to next step; and determining whether a stop command is received, if yes, then stopping sensing the heart rate of the user, if not, returning to the step of continually sensing the heart rate of the user.

2. The control method as claimed in claim 1, wherein after the step of determining whether a stop command is received, the control method further comprises following steps of:

entering a save mode and displaying a save request image to ask whether to save the operating command;

determining whether a save command is received, if yes, then saving the personal physical parameter set and the training program; and ending the save mode.

3. The control method as claimed in claim 2, wherein the step of receiving an operating command comprises following steps of:

receiving a mode selection command;

determining to enter either an automatic operating mode or a manual operating mode according to the mode selection command;

entering the automatic operating mode;

setting exercise level by receiving an intensity parameter;

receiving a program selection command and retrieving a preset training program;

generating an automatic operating command according to the intensity parameter and the preset training program; and outputting the automatic operating command to the display unit to have the display unit display corresponding posture display images and parameters of the preset training program.

4. The control method as claimed in claim 3, wherein when determining to enter the manual operating mode, the control method further comprises steps of:

entering the manual operating mode;

receiving a customized exercise parameter set;

generating a manual operating command according to the customized exercise parameter set; and outputting the manual operating command to the display unit to have the display unit display corresponding posture display images and parameters of customized exercise parameter set.

5. The control method as claimed in claim 2, wherein the personal physical parameter set includes a weight parameter, a height parameter, an age parameter and a gender parameter.

6. The control method as claimed in claim 4, wherein the customized exercise parameter set includes an intensity parameter, a time parameter and a posture parameter.

7. The control method as claimed in claim 3, wherein the preset training program includes multiple preset exercise parameter sets; and each preset exercise parameter set includes a time parameter and a posture parameter.

8. The control method as claimed in claim 1, wherein the boundary heart rate is defined with a personal heart rate formula, and the personal heart rate formula is:

boundary heart rate=220−(an age parameter×an intensity parameter) %.

9. The control method as claimed in claim 1 further comprising a step of calculating calories an exercising user consumed by a calculation formula:

$$\text{calories (kcal)} = \frac{(2 \times \pi \times Nm \times RPM/60) \times 0.01433}{0.23}; \quad \text{or}$$

$$\text{calories (kcal)} = \left\{\frac{(\text{intensity} \times METS \times \text{weight} \times \text{time})}{1000}\right\} \times 4.924;$$

wherein Nm means Newton meter; RPM means revolutions per minute of a flywheel of the exercise system; and METS means metabolic equivalent.

* * * * *